United States Patent [19]

Schmidt

[11] Patent Number: 4,620,415

[45] Date of Patent: Nov. 4, 1986

[54] METHOD FOR INITIATING DECOMPOSITION OF HYDRAZINE FUELS

[75] Inventor: Eckart W. Schmidt, Bellevue, Wash.

[73] Assignee: Rocket Research Company, Redmond, Wash.

[21] Appl. No.: 536,987

[22] Filed: Sep. 29, 1983

[51] Int. Cl.[4] ..... C06D 5/00

[52] U.S. Cl. ..... 60/219; 60/218

[58] Field of Search ..... 60/218, 219

[56] References Cited

U.S. PATENT DOCUMENTS

| | | | |
|---|---|---|---|
| 3,021,667 | 2/1962 | Griffin et al. | 60/35.4 |
| 3,081,595 | 3/1963 | Rose | 60/35.4 |
| 3,086,945 | 4/1963 | Cohn | 252/372 |
| 3,101,589 | 8/1963 | Hamrick et al. | 60/35.4 |
| 3,298,182 | 1/1967 | Webb | 60/251 |
| 3,383,860 | 5/1968 | Sayles | 60/218 |
| 3,503,212 | 3/1970 | Jennings et al. | 60/219 |
| 3,535,262 | 10/1970 | Hubbuch et al. | 252/186 |
| 3,667,231 | 6/1972 | Hubbuch et al. | 60/218 |
| 3,730,909 | 5/1973 | Armstrong et al. | 252/434 |
| 3,732,694 | 5/1973 | Blumenthal et al. | 60/218 |
| 3,757,520 | 9/1973 | Murfree et al. | 60/219 |
| 4,122,671 | 10/1978 | Armstrong et al. | 60/219 |
| 4,161,104 | 7/1979 | Ladacki | 60/218 |
| 4,162,292 | 7/1979 | Speeds et al. | 422/206 |

FOREIGN PATENT DOCUMENTS

| | | | |
|---|---|---|---|
| 1108192 | 6/1961 | Fed. Rep. of Germany | 121/30 |

OTHER PUBLICATIONS

Audrieth et al, "The Chemistry of Hydrazine", pp. 94–99, 115–125, 134–152 and 197–201, John Wiley & Sons (1951) New York.

Speyer, "Monopropellant Gas Generator (U)" Aug. 1967, pp. 3–4, Report RMD 5810F.

Thiokol Chemical Corporation, "(U) Low-Flame Temperature Gas Generator Propellants Program" Apr. 1966, pp. 47, 51, Report RMD 5066-F.

Shorr and Fricke, "A Non-Catalytic Ignition System" Dec. 1974, p. 543.

*Primary Examiner*—Edward A. Miller

*Attorney, Agent, or Firm*—Christensen, O'Connor Johnson & Kindness

[57] ABSTRACT

A method for initiating the decomposition of hydrazine fuels by bringing the fuel into contact with an initiator selected from the group consisting of iodates and periodates of metals from groups IIIB, IVB, VIB, VIIB, VIII, IB, IIB and IVA of the periodic table, ammonium iodate di-iodic acid, and heteropoly acids having iodine as their central atom and their salts.

4 Claims, No Drawings

METHOD FOR INITIATING DECOMPOSITION OF HYDRAZINE FUELS

BACKGROUND OF THE INVENTION

This invention relates to improved methods for initiating the decomposition of hydrazine fuels.

Hydrazine-based fuels are widely used as energy sources in monopropellant rocket engine and gas generator systems. These systems operate by introducing the hydrazine component into a reaction chamber, wherein it is caused to undergo an exothermic decomposition into gaseous products. An important consideration in such systems is the choice of means for initiating and sustaining the decomposition. Iridium has proven to be an effective catalyst for hydrazine decomposition, but it is in limited supply and quite expensive. Other elements capable of acting as catalysts include iron, nickel, cobalt, ruthenium and molybdenum. However, none of these other elements react spontaneously with hydrazine fuels at ambient temperature, and they therefore require some auxiliary means of initiating the decomposition reaction.

Three types of auxiliary initiation means have been described: pyrotechnic squibs, liquid hypergolic initiators, and solid hypergolic initiators. The use of pyrotechnic squibs limits the number of restarts to the number of squibs carried. Furthermore, squibs are susceptible to premature initiation by radio frequency induction and stray currents. The use of liquid hypergolic initiators detracts from the inherent reliability and simplicity of monopropellant systems by requiring a dual set of tanks, filters, valves and injectors. Solid hypergolic initiators have been tested on various occasions, but so far none have offered the necessary reactivity and environmental stability required for flight applications.

To be effective, a solid initiator must produce spontaneous ignition upon contact with hydrazine fuels. For many applications (e.g. aircraft), it must also maintain such reactivity down to about −65° F. To date, the most widely used solid initiator has been iodine pentoxide. This compound is a powder at ambient temperature, but it sublimes readily at temperatures above 575° F. It is very hygroscopic and deliquescent and, in the presence of even minute amounts of moisture, eventually converts to a syrup-like corrosive liquid. When iodine pentoxide is used, it is imperative to encapsulate it hermetically in the reactor to prevent it from migrating by sublimation and to avoid absorption of water.

SUMMARY OF THE INVENTION

The present invention provides novel methods for initiating the decomposition of hydrazine fuels. Such methods comprise bringing the fuel into contact with the solid initiators described below. The initiators used to practice the present invention do not have the undesirable corrosion and sublimation properties associated with iodine pentoxide. However, they have surprisingly been found to be equivalent to it in reactivity, even at temperatures down to −65° F.

The initiator compounds used in practicing the present invention are those selected from the group consisting of iodates and periodates of metals from groups IIIB, IVB, VIB, VIIB, VIII, IB, IIB and IVA of the periodic table, ammonium iodate di-iodic acid, and heteropoly acids having iodine as their central atom and their salts. All such initiators are capable of igniting hydrazine-based fuels upon contact. Furthermore, certain of these initiators have been found to possess the ability not only to rapidly initiate decompositions, but to sustain it as well. These compounds retain catalytic activity after the initial combustion reaction has proceeded to completion, such that the reactor can be restarted while still hot and can be operated in a pulse mode duty cycle similar to that used with more expensive iridium catalysts.

DETAILED DESCRIPTION OF THE INVENTION

The method of the present invention may be carried out in any suitable reaction vessel. Many examples of such vessels are described in the prior art. In a common arrangement, the hydrazine-based fuel is continuously injected into a reaction chamber which contains the initiator and any additional catalyst that may be required. The hydrazine fuel decomposes exothermically in the chamber into gaseous products, and the products then escape through a nozzle.

The hydrazine fuels that may be used to practice the present invention include hydrazine, hydrazine nitrate, and lower alkyl hydrazines such as methylhydrazine and 1,1-dimethylhydrazine, as well as mixtures of such compounds with one another and with other ingredients such as water and/or ammonia. Such mixtures are often used to provide fuels having low freezing points for aircraft applications.

The initiators used to practice the present invention can be applied in a variety of geometric shapes. They can be put to use as powder, pellets, tablets, spheres, saddles, extrudates, or monolithic blocks, or they can be applied as coatings on a support to aid in the retention of the reaction flame front in the reactor. If no support is used, the initiators are consumed and carried away with the reaction products, leaving a void in the area opposite the hydrazine injector. Such voids are generally undesirable because unreacted hydrazine can accumulate in the void and cause pressure spikes. If a support is used, it must be made of a heat resistant material insensitive to thermal shock, perferably with a large surface area, low heat capacity, and good thermal conductivity. Typical supports used for hydrazine fuels are composed of alumina and alumina-silica. They can have the shape of granules, pellets, tablets, spheres, saddles, hollow cylinders, extrudates, honeycombs, open-cell foams or monoliths. The initiator is coated on the support with or without the use of a binder such as colloidal silica or colloidal alumina. The coating thickness is chosen such as to have sufficient reactive material on hand for the first start, but also such as to minimize pressure drop and to avoid plugging any passages such as those found in an open-celled foam or honeycomb.

The initiators used to practice the present invention fall into two groups: selected iodates and periodates; and heteropoly acids having iodine as their central atoms and their salts. The initiators in the first group consist of iodates and periodates of metals from groups IIIB, IVB, VIB, VIIB, VIII, IB, IIB and IVA of the periodic table, and ammonium iodate di-iodic acid. Certain of these initiators, including nickel iodate, iron iodate, and cobalt iodate, have the ability to both initiate hydrazine decomposition and to catalytically sustain the decomposition as well. Therefore, no additional catalysts are required when one of these initiators is used. A preferred method of carrying out the present invention with these initiators is to coat the initiator on an appropriate support, as described above. A support will retain a sufficient amount of the initiator, or its reduction products, to sustain the first burning cycle. It will also have the ability to restart the reactor while still hot, thereby allowing a pulsed mode of operation. Other initiators in the first group, for example mercury iodate, cerium iodate, zinc iodate, silver iodate, silver periodate, copper iodate, titanyl iodate, lead iodate, tin iodate, chromium iodate, cadmium iodate and ammonium iodate di-iodic acid, do not have the capability of sustaining the hydrazine decomposition. When these initiators are used, a preferred method is to coat the initiator on an appropriate support together with a catalyst capable of sustaining hydrazine decomposition while hot. Suitable catalysts include iron, nickel, cobalt, ruthenium and molybdenum.

A second group of initiators of the present invention comprises heteropoly acids having iodine as their central atom, and their salts. Specific examples of initiators in this group include hexamolybdatoperiodic acid, hexatungstatoperiodic acid, hexachromatoperiodic acid, hexarhenatoperiodic acid, and ammonium hexamolybdatoperiodate. All of the compounds in this group can both initiate and sustain the decomposition of hydrazine fuels, and can be used without additional catalysts.

The following examples are provided to further teach one of ordinary skill in the art how to practice the present invention.

EXAMPLE 1

The compounds listed in Tables I, II, and III were tested to determine the ignition delay when such compounds were brought into contact with hydrazine fuels. All of the compounds were prepared by standard methods well known to those skilled in the art. By way of example, mercury (II) iodate was prepared by dissolving 62.2 grams of $Hg(NO_3)_2H_2O$ in 200 ml. of water, and mixing the resulting solution with a second solution consisting of 62.09 grams of iodine pentoxide in 200 ml. of water. The white precipitate was filtered, washed and dried to yield 90 grams of $Hg(IO_3)_2$.

TABLE I

Ignition Delay in Seconds at 32° F.
70% Hydrazine/30% Water

| Initiator | Formula | Delay |
|---|---|---|
| Mercury (II) iodate | $Hg(IO_3)_2$ | 0.06 |
| Ammonium iodate di-iodic Acid | $NH_4IO_3.2HIO_3$ | 0.12 |
| Cerium (IV) iodate | $Ce(IO_3)_4$ | 0.10 |
| Titanyl (IV) iodate | $TiO_2(IO_3)_2$ | 0.08 |
| Zinc (II) iodate | $Zn(IO_3)_2$ | 0.18 |
| Silver (I) iodate | $AgIO_3$ | 0.06 |
| Silver (I) periodate | $AgIO_4$ | 0.07 |
| Nickel (II) iodate | $Ni(IO_3)_2$ | 0.10 |
| Iron (III) iodate | $Fe(IO_3)_3$ | 0.09 |

TABLE II

Ignition Delay in Seconds at 32° F.

| Initiator | Formula | Delay Fuel A | Delay Fuel B | Delay Fuel C |
|---|---|---|---|---|
| Mercury (II) iodate | $Hg(IO_3)_2$ | 0.01 | Not Tested | Not Tested |
| Cerium (IV) iodate | $Ce(IO_3)_4$ | 0.07 | 0.09 | 0.17 |
| Titanyl (IV) iodate | $TiO_2(IO_3)_2$ | 0.08 | 0.10 | 0.20 |
| Zinc (II) iodate | $Zn(IO_3)_2$ | 0.09 | 0.13 | 1.00 |
| Silver (I) iodate | $AgIO_3$ | 0.08 | 0.09 | 0.06 |

TABLE II-continued

Ignition Delay in Seconds at 32° F.

| Initiator | Formula | Delay Fuel A | Delay Fuel B | Delay Fuel C |
|---|---|---|---|---|
| Silver (I) periodate | $AgIO_4$ | 0.09 | 0.06 | 0.20 |

Fuel A - 100% hydrazine
Fuel B - 58% hydrazine, 25% hydrazine nitrate, 17% water
Fuel C - 86% methyl hydrazine, 14% hydrazine

TABLE III

Ignition Delay in Seconds at −65° F.

| Initiator | Formula | Delay Fuel B | Delay Fuel C | Delay Fuel D |
|---|---|---|---|---|
| Mercury (II) iodate | $Hg(IO_3)_2$ | 0.01 | 1.10 | 0.08 |
| Ammonium iodate di-iodic Acid | $NH_4IO_3\ 2HIO_3$ | 0.08 | 1.40 | 0.13 |
| Nickel (II) iodate | $Ni(IO_3)_2$ | 1.00 | No reaction | 0.07 |
| Iron (III) iodate | $Fe(IO_3)_3$ | 0.06 | 1.60 | 0.06 |
| Iodine pentoxide | $I_2O_5$ | 0.07 | 0.07 | 0.10 |

Fuel B - 58% hydrazine, 25% hydrazine nitrate, 17% water
Fuel C - 86% methyl hydrazine, 14% hydrazine
Fuel D - 70% hydrazine, 30% water For each of the tests listed in Tables I, II and III, 200 mg. of the dry initiator (powder or crystals) was placed in a test tube, and a bare-wire thermocouple was immersed in the solid to record the initial temperature and the temperature rise upon addition of the hydrazine fuel. The output from the thermocouple was recorded on a strip chart recorder along with the signal of an event marker which indicated the moment at which the hydrazine fuel was injected into the solid from a syringe with a hypodermic needle. The time elapsed between fuel injection and incipient exothermic reaction was measured and tabulated as indicated in Tables I–III. Table I shows the reactivity of the initiators of the present invention at 32° F. with a common low freezing fuel mixture consisting of 70% hydrazine and 30% water. Table II illustrates the reactivity of several of these compounds with other hydrazine-based fuels at 32° F., while Table III demonstrates reactivity at −65° F. Table III includes iodine pentoxide for comparison purposes.

EXAMPLE 2

A number of initiators used for the present invention were visually tested at ambient temperature. These tests involved dropping a small quantity of hydrazine onto a sample of the initiator on a spot plate. The results are listed in Table IV. As indicated, all compounds reacted spontaneously to ignite the hydrazine.

TABLE IV

Visual Ignition Tests

| Initiator | Formula | Result |
|---|---|---|
| Cobalt (II) iodate | $Co(IO_3)_2$ | Bright white flash |
| Lead (II) iodate | $Pb(IO_3)_2$ | Slow, light blueish flame |
| Tin (IV) iodate | $Sn(IO_3)_4$ | Very active, loud pop noise |
| Chromium (III) iodate | $Cr(IO_3)_3$ | Very active, instant flame |
| Copper (II) iodate | $Cu(IO_3)_2$ | Blue flash, loud pop noise |
| Cadmium (II) iodate | $Cd(IO_3)_2$ | Slow ignition |
| Hexamolybdato-periodic acid | $H_5I(MoO_4)_6$ | Spontaneous ignition, limited restart after cooldown |
| 27% Hexamolybdato- | $H_5I(MoO_4)_6/Al_2O_3$ | Spontaneous |

TABLE IV-continued

| Initiator | Visual Ignition Tests Formula | Result |
|---|---|---|
| periodic on alumina | | ignition, continued restart capability while still hot |
| Ammonium hexa-molybdatoperiodate | $(NH_4)_5I(MoO_4)_6$ | Spontaneous ignition, limited restart after cooldown |

EXAMPLE 3

The hexamolybdatoperiodic acid used in Example 2 was prepared by dissolving 22.8 grams of periodic acid in 50 ml of water and pouring the resulting solution into a heated suspension of 96.6 grams of molybdic acid ($H_2MoO_4$) in 200 ml of water. The slurry became a clear solution from which colorless crystals were obtained after cooling. The crystals were filtered, washed and dried in a vacuum desiccator to yield 79 grams of hexamolybdatoperiodic acid.

It will be understood that the invention may be embodied in other specific forms without departing from the spirit or central characteristics thereof. The present examples and embodiments, therefore, are to be considered in all respects as illustrative, and the invention is not to be limited to the details given herein, but may be modified within the scope of the following claims.

I claim:

1. A method for spontaneously initiating the decomposition of a liquid hydrazine fuel, comprising contacting the hydrazine fuel with a nonhydroscopic solid initiator comprising at least one compound selected from the group consisting of heteropoly acids having iodine as their central atom and their salts.

2. The method of claim 1, wherein the heteropoly acid is selected from the group consisting of hexamolybdatoperiodic acid, hexatungstatoperiodic acid, hexachromatoperiodic acid and hexarhenatoperiodic acid.

3. The method of claim 1, wherein the compound is selected from the group consisting of hexamolybdatoperiodic acid and ammonium hexamolybdatoperiodate.

4. The method of claim 1, wherein the hydrazine fuel is selected from the group consisting of hydrazine, monomethylhydrazine and hydrazine nitrate.

* * * * *